US007578025B2

(12) United States Patent
Kostreba et al.

(10) Patent No.: US 7,578,025 B2
(45) Date of Patent: Aug. 25, 2009

(54) BATTERY POWERED CLEANING ATTACHMENT

(75) Inventors: Steve Kostreba, Eastlake, OH (US); Steve Dings, Mentor, OH (US); David Khalil, Highland Heights, OH (US); Andrew A. Amberik, Streetsboro, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 101 days.

(21) Appl. No.: 11/434,980

(22) Filed: May 16, 2006

(65) Prior Publication Data

US 2007/0266519 A1 Nov. 22, 2007

(51) Int. Cl.
*A47L 7/00* (2006.01)

(52) U.S. Cl. ..... 15/321; 315/320; 315/322

(58) Field of Classification Search ..... 15/320, 15/321, 322

See application file for complete search history.

(56) References Cited

U.S. PATENT DOCUMENTS

| | | | | |
|---|---|---|---|---|
| 4,005,502 | A | 2/1977 | Stevens (Boyer) | |
| 4,137,588 | A * | 2/1979 | Sandt et al. | 15/22.1 |
| 4,397,056 | A | 8/1983 | Miller | |
| 4,893,375 | A | 1/1990 | Girman et al. | |
| 5,367,740 | A | 11/1994 | McCray | |
| 5,400,468 | A | 3/1995 | De Petra | |
| 5,423,102 | A * | 6/1995 | Madison | 15/22.2 |
| 5,649,334 | A | 7/1997 | Henriquez et al. | |
| 5,765,258 | A * | 6/1998 | Melito et al. | 15/352 |
| 5,867,864 | A * | 2/1999 | Miller et al. | 15/387 |
| 5,950,268 | A | 9/1999 | Murphy et al. | |
| 5,956,792 | A | 9/1999 | Gutelius et al. | |
| 6,134,746 | A | 10/2000 | Miller et al. | |
| 6,185,781 | B1 * | 2/2001 | Miller et al. | 15/322 |
| 6,253,405 | B1 | 7/2001 | Gutelius et al. | |
| 6,292,971 | B1 | 9/2001 | Chaudray | |
| 6,311,366 | B1 * | 11/2001 | Sepke et al. | 15/412 |
| 6,571,421 | B1 * | 6/2003 | Sham et al. | 15/320 |
| 6,763,549 | B1 * | 7/2004 | Peters | 15/374 |

(Continued)

FOREIGN PATENT DOCUMENTS

| | | |
|---|---|---|
| CA | 2 283 908 A1 | 3/2001 |

(Continued)

OTHER PUBLICATIONS

International Search Report; Date of Mailing Aug. 24, 2007; Form PCT/ISA/210, 4 pages.

*Primary Examiner*—Joseph J Hail, III
*Assistant Examiner*—Shantese McDonald
(74) *Attorney, Agent, or Firm*—Fay Sharpe LLP

(57) ABSTRACT

The disclosure relates to a hand-held cleaning device including an elongated nozzle base having opposed first and second ends and a longitudinal axis. The second end is releasably connected to a hand-held suction wand of a vacuum source. The longitudinal axis of the elongated nozzle base is aligned with a longitudinal axis of the wand. A battery is located in the elongated nozzle base. A DC motor is located in the elongated nozzle base and is electrically connected to the battery. The motor has an axially rotated output drive shaft. A drive assembly is connected to the drive shaft for rotation therewith. A first brush is located at the first end of the elongated nozzle base and is connected to the drive assembly.

26 Claims, 11 Drawing Sheets

U.S. PATENT DOCUMENTS

| | | | | |
|---|---|---|---|---|
| 6,968,593 | B1 * | 11/2005 | Lenkiewicz et al. | 15/320 |
| 2003/0177595 | A1 | 9/2003 | Quach | |
| 2003/0182758 | A1 | 10/2003 | Hisano et al. | |
| 2004/0074025 | A1 | 4/2004 | Blaustein et al. | |
| 2004/0237228 | A1 | 12/2004 | King et al. | |
| 2004/0255410 | A1 | 12/2004 | Schonewille et al. | |
| 2006/0037173 | A1 | 2/2006 | Gursel | |

FOREIGN PATENT DOCUMENTS

| | | | |
|---|---|---|---|
| DE | 198 55 101 | A1 | 6/2000 |
| EP | 1 386 573 | A2 | 2/2004 |
| JP | 11032971 | A | 2/1999 |
| WO | WO 02/49497 | A2 | 6/2002 |
| WO | WO 2004/014184 | A1 | 2/2004 |
| WO | WO 2004/064572 | | 8/2004 |

* cited by examiner

BATTERY POWERED CLEANING ATTACHMENT

BACKGROUND OF THE INVENTION

The present invention relates to a hand-held battery powered cleaning device. It finds particular application in conjunction with a home appliance, such as a carpet extractor or other wet pickup cleaner, and will be described with particular reference thereto. However, it is to be appreciated that the present invention is also amenable to other like applications, such as use with upright or canister vacuum cleaners.

It is known in the prior art to provide hand-held extractor nozzles and scrubbers with turbine powered agitators, such as one or more scrub brushes. Horizontally oriented brush rolls and vertically oriented brushes are known for such hand-held nozzles. These prior art turbine powered extractor nozzles and scrubbers are designed for attachment to the end of an elongate handle or suction wand. The opposite end of the wand is typically attached to a canister type extractor or upright type vacuum cleaner or a wet/dry vacuum cleaner by a flexible suction hose. However, such nozzles with turbine powered agitators are disadvantageous because they do not provide sufficient power to their brush or brushes to effectively and easily clean stairs or upholstery, for example. Auxiliary motors in such hand-held attachments have not been used because powering an auxiliary motor driving a brush in a hand-held unit via an electrified hose is disadvantageous for several reasons. First, it is expensive to provide such a hose, especially when it needs to accommodate liquids as well. Second, wear and tear on the hose could well lead to a short for the electrical conduit in the hose, thereby also disabling the motor.

Accordingly, there is a need for a new and improved hand-held cleaning device which overcomes certain difficulties with the prior art designs while providing better and more advantageous overall results.

BRIEF DESCRIPTION OF THE INVENTION

In one embodiment of the present invention, a hand-held cleaning device is provided.

More particularly, in accordance with this aspect of the present invention, a hand-held cleaning device comprises an elongated nozzle base including opposed first and second ends and a longitudinal axis. The second end is releasably connected to a hand-held suction wand of an associated vacuum source. The longitudinal axis of the elongated nozzle base is aligned with a longitudinal axis of the wand. A battery is located in the elongated nozzle base. A DC motor is located in the elongated nozzle base and is electrically connected to the battery. The motor includes an output drive shaft. A drive assembly is connected to the drive shaft for rotation therewith. A first brush is located adjacent the first end of the elongated nozzle base and is connected to the drive assembly.

In accordance with another aspect of the present invention, a hand-held motorized cleaning device comprises a nozzle base having opposed first and second ends and a longitudinal axis. The second end is operatively connected to a vacuum source. The nozzle base includes a nozzle opening and a housing extending outwardly from a sidewall of the nozzle base. A battery is located in the housing. A motor is mounted to the nozzle base and electrically connected to the battery. The motor includes an output shaft which is configured to produce a rotary motion. A drive assembly is connected to the output shaft. A first brush is connected the drive assembly.

The brush has an axis of rotation generally perpendicular to the longitudinal axis of the nozzle base.

In accordance with yet another aspect of the present invention, a self-powered hand-held cleaning device for connection with a carpet extractor, to enable above floor cleaning, comprises a generally hollow nozzle base including a nozzle releasably connected to an associated vacuum source. A battery is mounted to the nozzle base. A DC motor is mounted to the nozzle base and operably connected to the battery. First and second brushes are operably connected to the motor to produce an oscillating motion of the first and second brushes, at the same time as a suction is drawn at the nozzle.

Still other aspects of the invention will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

DETAILED DESCRIPTION OF THE INVENTION

Figure 1:
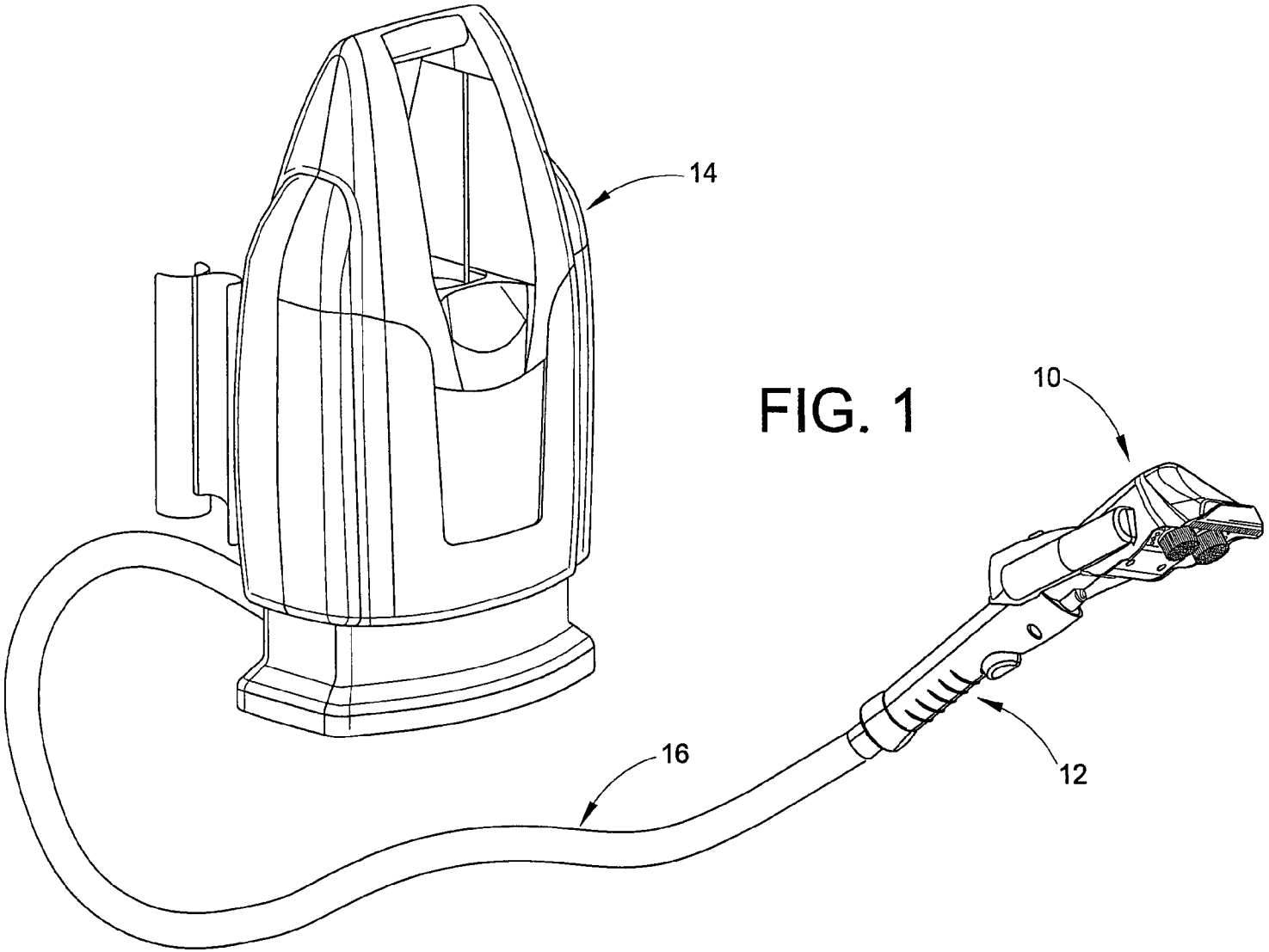
FIG. 1 is a perspective view illustrating a hand-held cleaning device in accordance with an embodiment of the present invention, shown as being connected to a hand-held suction and spray wand of a portable extractor.

It should, of course, be understood that the description and drawings herein are merely illustrative and that various modifications and changes can be made in the structures disclosed without departing from the spirit of the invention. Like numerals refer to like parts throughout the several views. It will also be appreciated that the various identified components of the vacuum cleaner disclosed herein are merely terms of art that may vary from one manufacturer to another and should not be deemed to limit the present invention. All references to direction and position, unless otherwise indicated, refer to the orientation of the hand-held cleaning device illustrated in the drawings.

Referring now to the drawings, wherein the drawings illustrate several embodiments of the present invention only and are not intended to limit same, FIG. 1 shows a hand-held cleaning device 10 in accordance with one aspect of the present invention selectively attached to one end of a hand-held suction and spray wand 12. The opposite end of the wand is connected to a vacuum source, such as a portable carpet extractor 14, by a flexible suction hose 16. While the invention is discussed in connection with a carpet extractor, it could also be adapted for use with a variety of other household cleaning appliances, such as upright vacuum cleaners, bare floor cleaners, "shop" type cleaners, canister cleaners, and built-in units.

Figure 2:
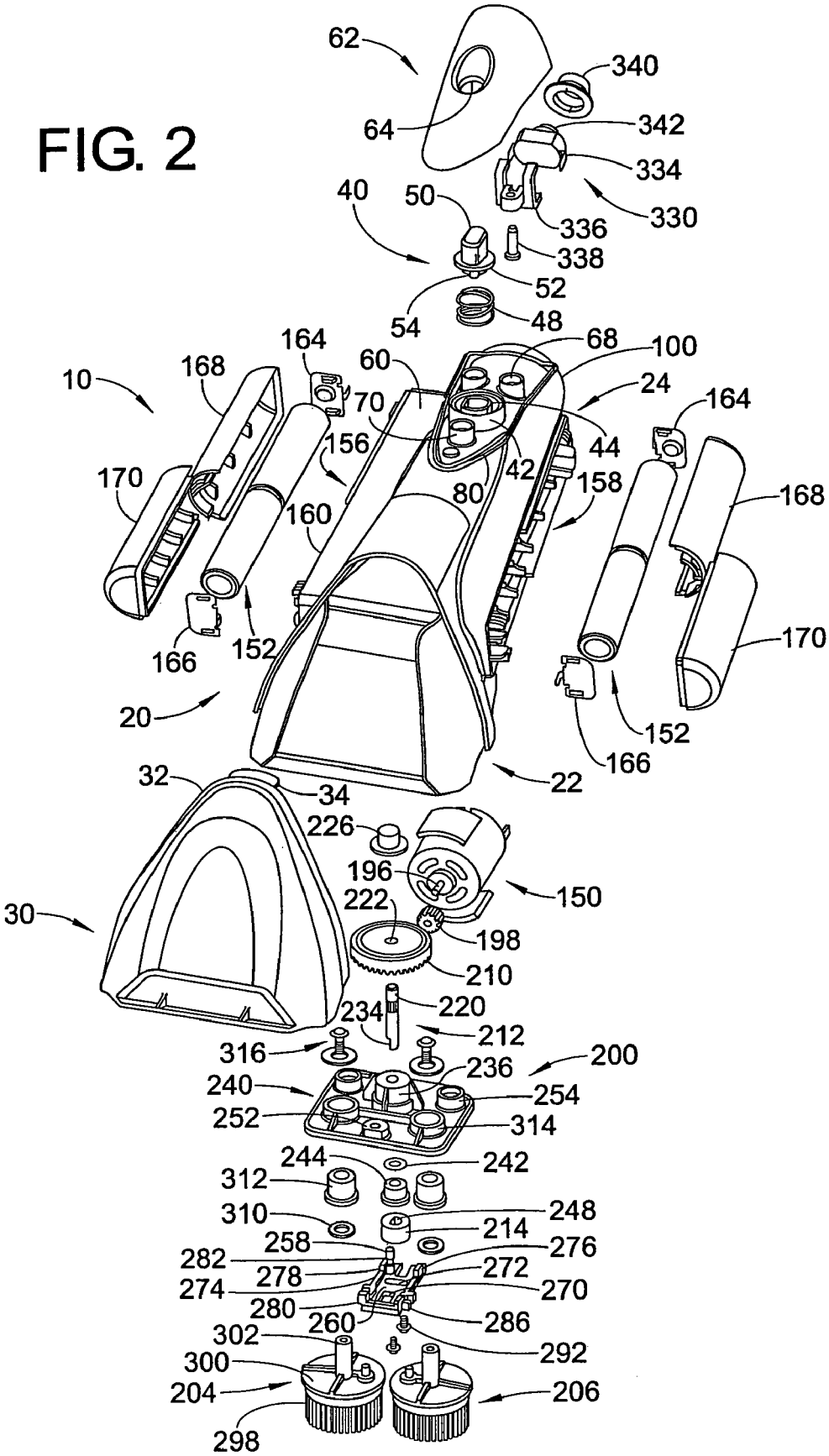
FIG. 2 is an exploded top perspective view of the hand-held cleaning device of FIG. 1.
Figure 3:
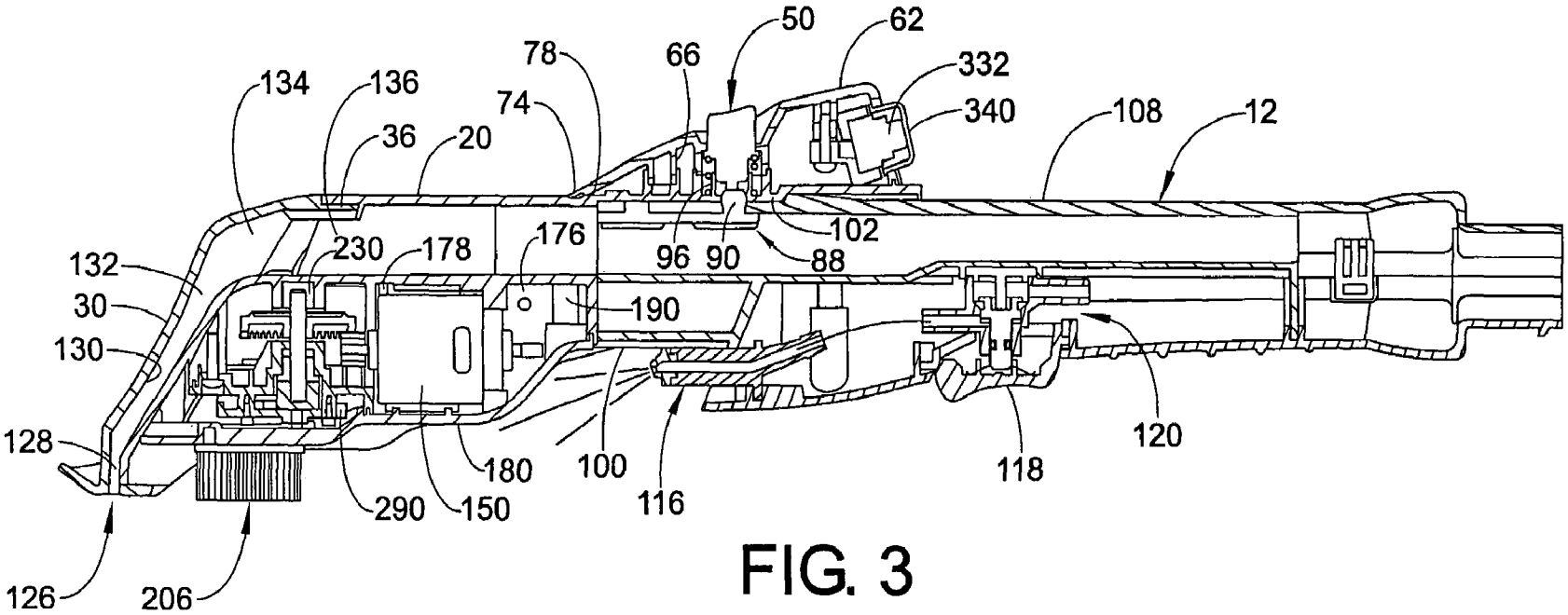
FIG. 3 is a side cross-sectional view of the hand-held cleaning device of FIG. 1.
Figure 9:
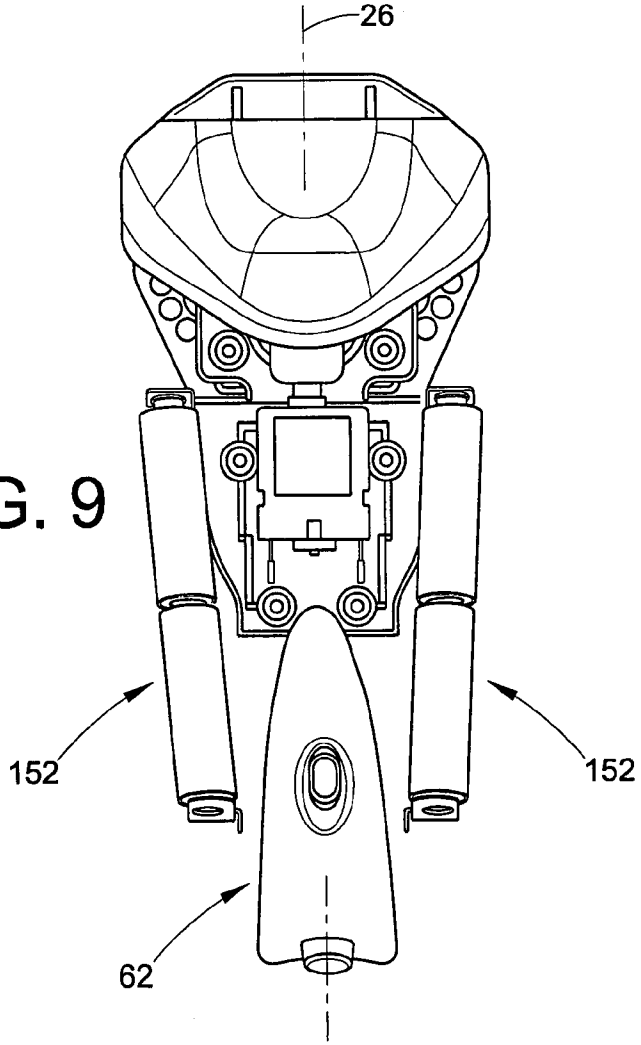
FIG. 9 is a top plan view, partially broken away, of the hand-held cleaning device of FIG. 7.

With reference to FIGS. 2 and 3, the hand-held cleaning device 10 includes a generally hollow, elongated nozzle base 20 having opposed first and second ends 22 and 24, respectively, and a longitudinal axis 26 (FIG. 9). A nozzle cover 30 is releasably attached to the first end of the nozzle base. In the depicted embodiment, an upper end 32 of the nozzle cover includes a tab 34 for engaging a slot 36 located at the first end of the nozzle base. However, it will be appreciated that alternative means for attaching the nozzle cover to the nozzle base are also contemplated, including any conventional means for doing so.

The second end 24 of the nozzle base 20 is releasably connected to the hand-held suction and spray wand 12 via a release button assembly 40 operatively mounted to the second end. More particularly, the second end includes a first boss 42 having an upwardly extending, hollow projection 44 for receiving a spring 48. A button 50 having a shelf 52 and a projection 54 is partially inserted into the hollow projection 44 such that the spring is partially compressed between a top surface 60 of the nozzle base and the shelf. A cover 62 is then attached to the top surface 60. The cover includes an opening 64 dimensioned for passage of the button 50 and a plurality of downwardly extending bosses 66. The bosses 66 are received in openings 68 of corresponding second bosses 70 located on the second end 22 of the nozzle base 20. A bottom end 74 of the cover 62 also includes a groove 78 for receiving a rim 80 located on the top surface 60, the rim at least partially surrounding the second bosses 70.

Figures 4, 5:
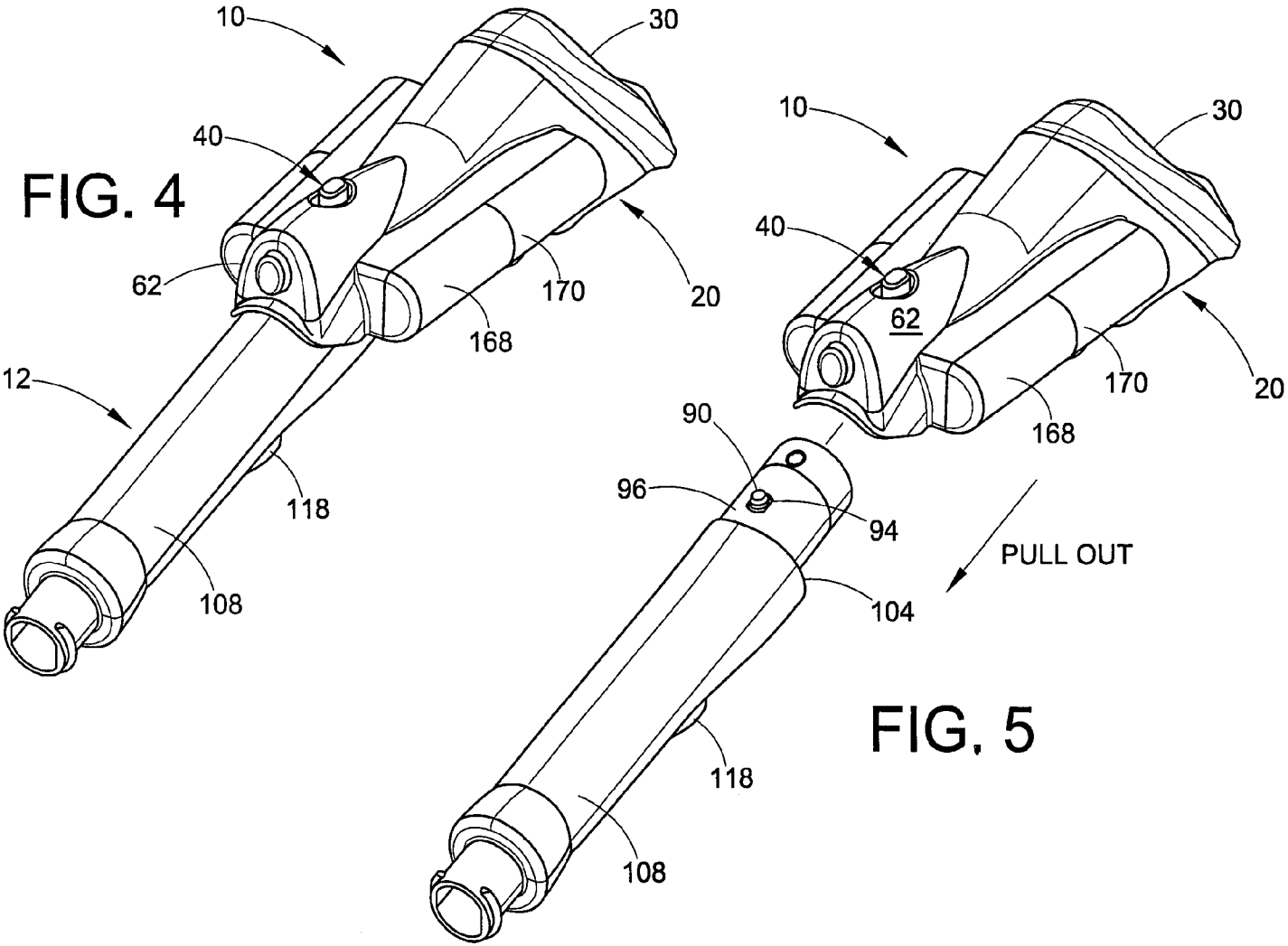
FIG. 4 is a top perspective view of the hand-held cleaning device of FIG. 1 attached to the hand-held suction and spray wand of FIG. 1.
FIG. 5 is a top perspective view of the hand-held cleaning device of FIG. 1 separated from the hand-held suction and spray wand of FIG. 1.

With continued reference to FIG. 3, the spring 48 biases the projection 52 of the button 50 through an opening located on the top surface 60 of the nozzle base into and out of engagement with a locking mechanism 88 of the suction and spray wand 12. With reference now to FIGS. 4 and 5, the locking mechanism includes a finger 90 extending through a corresponding opening 94 located on a top surface 96 of the wand. Upon insertion of the wand into an enlarged first open end section 98 of a fluid channel 100, the finger is biased downward by an upper wall 102 (FIG. 3) of the channel. The wand is inserted until an end 104 of a hand grip 108 engages the open first end of the channel. At this position, the opening 94 of the wand is generally aligned with the opening located on the top surface 60 of the nozzle base 20, the finger springing through both openings. Once securely attached, the longitudinal axis of the nozzle base 20 is aligned with a longitudinal axis of the wand 12. To remove the Wand, the button 50 is depressed. This, in turn, moves the button projection 54 downward into engagement with the finger 90 thereby pushing the finger out of the opening located on the top surface 60 of the nozzle base 20. The wand 12 can then be easily pulled out of the channel 100.

With reference once more to FIG. 3, the hand-held spray and suction wand 12 generally includes a cleaning liquid applicator, such as a spray nozzle 116, that can be connected to a cleaning liquid supply pump (not shown) of the carpet extractor 14 by a flexible supply hose located in the hose 16. The spray nozzle is located adjacent the nozzle base 20 and the longitudinal axis 26 of the nozzle base can be aligned with a longitudinal axis of said spray nozzle. A trigger 118 operates a valve assembly 120 which communicates the spray nozzle 116 with the liquid supply tube for selectively spraying cleaning liquid out the spray nozzle onto a surface to be cleaned. The wand 14 includes the hand grip 108 that the operator may grasp with one hand for convenient above floor cleaning.

Figure 7:
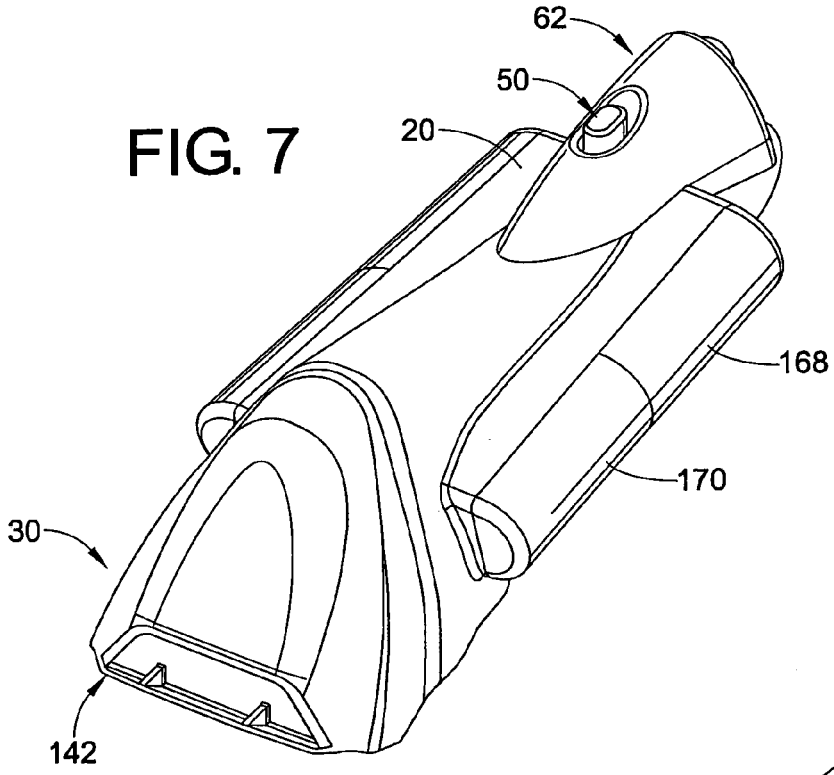
FIG. 7 is a top perspective view of the hand-held cleaning device of FIG. 1.
Figure 6:
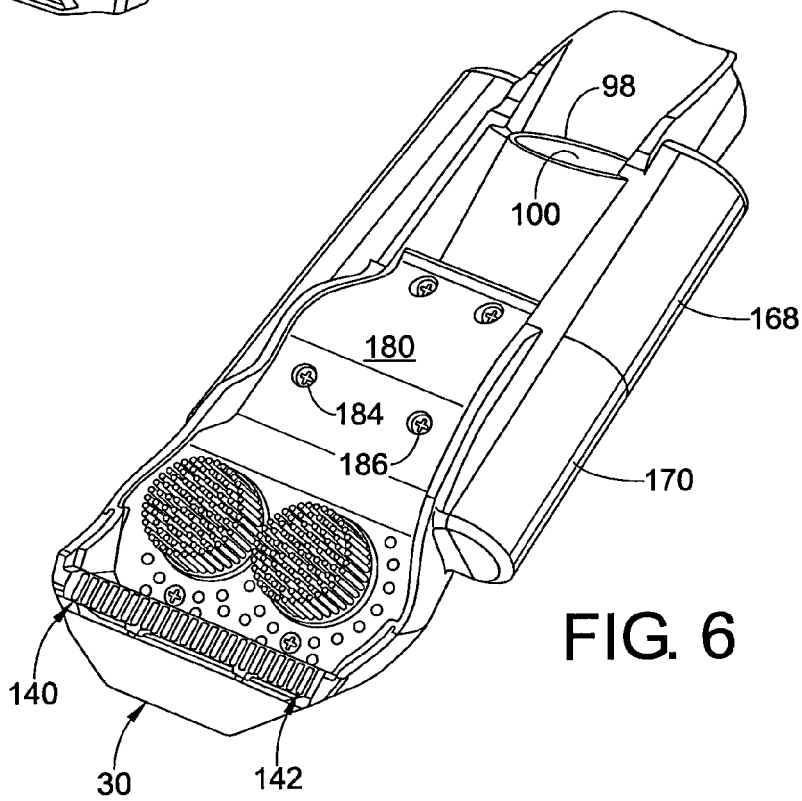
FIG. 6 is a bottom perspective view of the hand-held cleaning device of FIG. 1.

With continued reference to FIG. 3, the nozzle cover 30 and the first end 22 of the nozzle base 20 define an inlet section or nozzle 126 having an inlet 128 through which air entrained dirt and dirt entrapped liquid flows from a surface to be cleaned. The nozzle cover includes an inwardly depressed section 130 for narrowing a passageway 132 in the inlet section thereby creating a venturi effect for increasing vacuum in the inlet section. An outlet 134 of the passageway is in fluid communication with a second smaller open end section 136 of the channel 100. As shown in FIGS. 6 and 7, a surface engaging section 140 of the first end 22 of the nozzle base 20 includes a plurality of slits 142. The slits can reduce friction between the surface engaging section and a surface to be cleaned and also allow extra air into the inlet 128 of the nozzle 126.

With reference again to FIG. 2, a motor 150 is located in the nozzle base 20 and is electrically connected to a source of energy, such as a battery. In the depicted embodiment, the motor 150 is electrically connected to replaceable AA batteries 152 housed in first and second axially opposed open chambers 156 and 158, respectively. It should be appreciated that the batteries can be rechargeable and that AA sized batteries are not required. Each chamber extends outwardly from a sidewall 160 of the nozzle base. Conventional electrical contacts 164, 166 for the batteries are mounted to opposed ends of each chamber. First and second covers 168 and 170, respectively, close each chamber. As shown in FIG. 3, the motor 150 can be sealed in a motor housing 176 defined by a bottom wall 178 of the channel 100 and a bottom plate 180. As shown in FIG. 6, the bottom plate is attached to the nozzle base 20 by conventional fasteners, such as screws 184, inserted through holes 186 in the bottom plate. The screws engage sleeves 190 (FIG. 3) formed integrally with the chamber wall 178.

Figure 8:
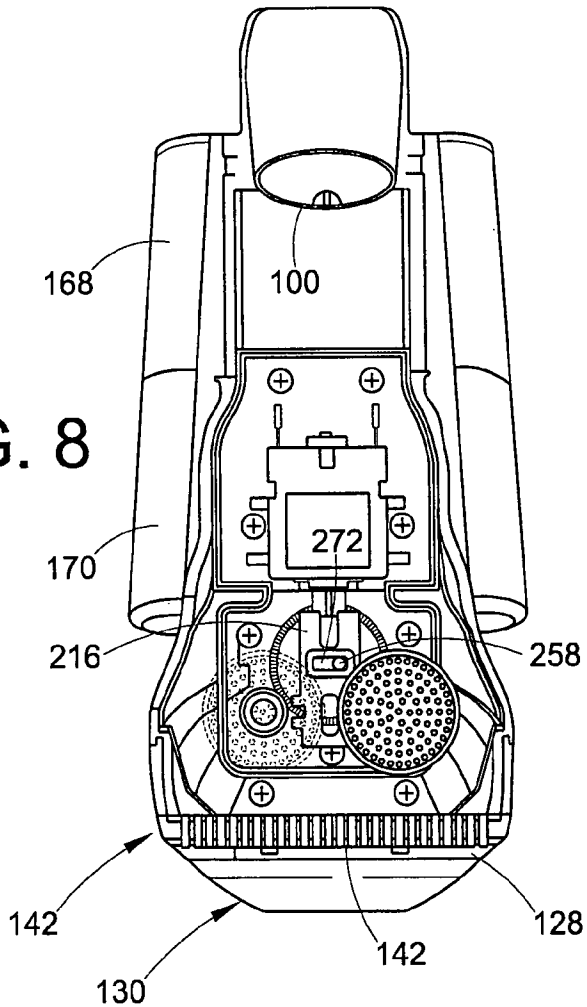
FIG. 8 is a bottom plan view, partially broken away, of the hand-held cleaning device of FIG. 6.

As illustrated in FIGS. 2 and 3, the motor includes an output drive shaft 196 which is configured to produce a rotary motion. A longitudinal axis of the shaft is generally aligned with the longitudinal axis of the nozzle base 20 (FIGS. 8 and 9). A spur gear 198 is securely mounted to an end of the output shaft. A control element (not shown) for varying the speed of rotation of the drive shaft can be operably connected to the motor. The speed of rotation can be selectively increased or decreased by a speed change knob (not shown) connected to the control element. A drive assembly 200 is connected to the output shaft for rotation therewith. The drive assembly is operatively connected to cleaning attachments, such as the illustrated first and second brushes 204 and 206, respectively. Rotation of the output drive shaft 196 of the motor 150 causes the drive assembly 200 to operably oscillate the first and second brushes in unison.

Figure 10:
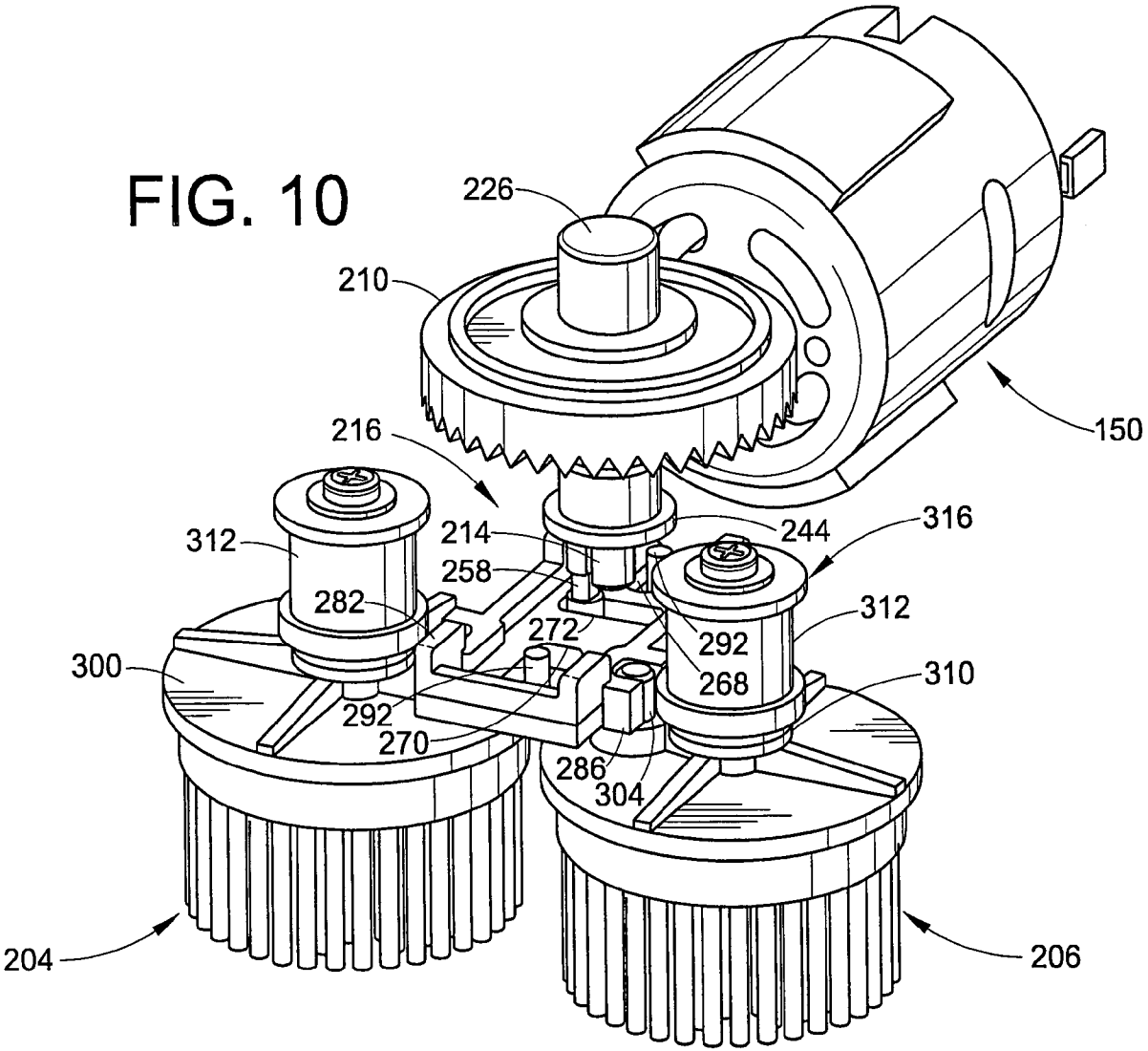
FIG. 10 is an enlarged front perspective view of a portion of a drive assembly of the hand-held cleaning device of FIG. 1.

With additional reference to FIG. 10, the drive assembly 200 includes a face gear 210, a shaft 212 (FIG. 2), a cam 214 and a connector or ram 216. As shown in FIG. 2, a first end 220 of the shaft 212 extends through a hole 222 in the face gear and is received in an upper bushing 226 housed in a hollow projection 230 extending downwardly from the channel wall 178. A second, keyed end 234 of the shaft 212 extends though an aperture of an upwardly extending projection 236 of a mounting plate 240, an anti-wear ring 242, which can be made from a lubricious material, such as nylon, and a lower bushing 244 housed in the projection 236 and into a corresponding keyed opening 248 located on a top surface of the cam 214. As shown in FIG. 3, the mounting plate can be fastened to the nozzle base 20 by fasteners (not shown) extending through respective bosses 252, 254.

A pin 258 extends from a bottom surface of the cam and engages the ram. In the present embodiment, the pin includes a keyed first end which is inserted into a corresponding keyed opening located on the bottom surface of the cam; although, this is not required. As will be described in greater detail below, rotation of the cam 214 and pin 250 causes the ram 216 to reciprocally move in a direction generally perpendicular to rotational axes of the first and second brushes 204, 206. Thus, a linear movement of the ram 216 oscillates the first and second brushes.

In the depicted embodiment, the ram 216 includes a generally rectangular base 260; however, it should be appreciated that other shapes are also contemplated. First and second slots 268 and 270, respectively, extend from opposed ends of the base. The slots have a longitudinal axis generally parallel to the longitudinal axis of the nozzle base 20. A generally oblong aperture 272 is located on the base between the first and second slots and has a longitudinal axis generally normal to the longitudinal axes of the slots. As shown in FIG. 8, a second end of the pin 258 is positioned in the oblong aperture 272. The ram further includes a pair of side walls 276, 278 and a front wall 280, each wall extending upwardly from the base 260. Each side wall includes at least one foot 282 having a generally planar surface adjacent one of the ends of the base and an outwardly extending, generally C-shaped tab 286. The feet provide a space between the ram and a bottom surface of the mounting plate. The mounting plate includes a pair of downwardly extending sleeves 290 (FIG. 3) dimensioned to be slidingly received in the slots 268, 278 of the ram. To attach the ram 216 to the mounting plate 240, the sleeves are positioned in the slots so that the feet slidingly engage the bottom surface of the mounting plate. Fasteners, such as screws 292, threadingly engage the sleeves 290 from a bottom surface of the base 260.

With reference to FIGS. 2 and 3, the first and second brushes 204, 206 are located adjacent the first end 22 of the nozzle base 20. The brushes are rotatably attached to the drive assembly 200 to produce an oscillating motion of the first and second brushes, at the same time as a suction is drawn at the nozzle 126 of the nozzle base. The axis of oscillation of each brush is generally normal to the longitudinal axis of the nozzle base. Each brush includes bristles 298 secured to a top plate 300 and a stem 302 and a pin 304 extending upwardly from the top plate. As is conventional, the bristles can be bunched in tufts.

To mount the brushes to the drive assembly 200, the pins are snapped into the C-shaped tabs 286 and the stems are rotatably attached to the mounting plate 240. Particularly, each stem extends though an anti-wear ring 310, which can be made from a lubricious material, such as nylon, and a bushing 312 housed in a hollow projection 314 located on a top surface of the mounting plate. Fasteners, such as screws 316, threadingly engage the stems from the top surface of the mounting plate. As shown in FIG. 3, once assembled, the inlet 128 of the nozzle 126 lies a first plane. An operating surface of each brush lies in a second plane which extends at an acute angle relative to the first plane. In other words, the brushes can be oriented at a slight acute angle in relation to a plane of the nozzle inlet 128. This can be advantageous be placing less stress on the drive assembly 200 and the motor 150 when the cleaning device 10 is cleaning upholstery or the like.

Figure 11:
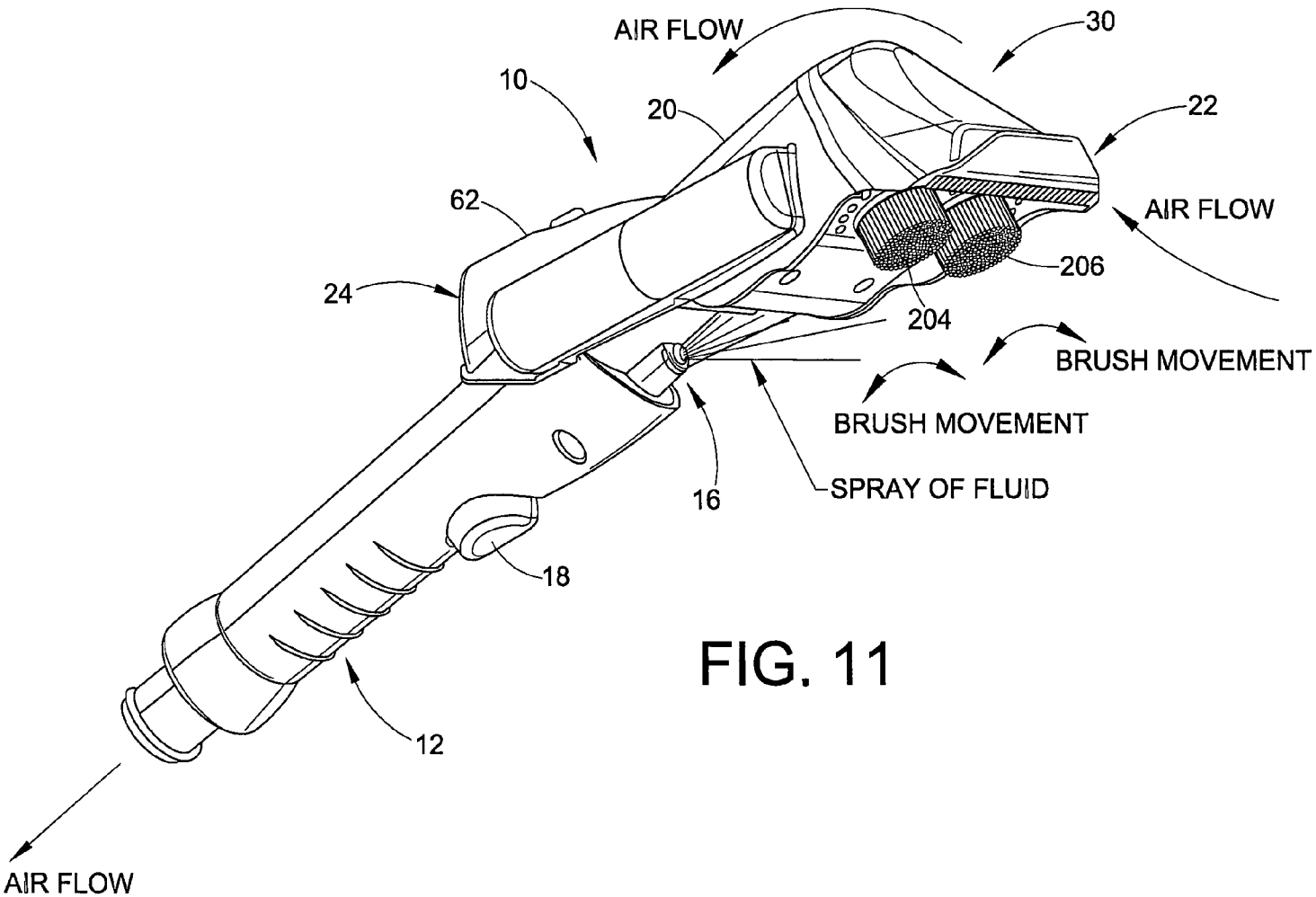
FIG. 11 is a side perspective view of the hand-held cleaning device of FIG. 1 selectively attached to the hand-held suction and spray wand of FIG. 1.

To actuate the motor 150, a trigger assembly 330 is operatively mounted to the cover 62. Specifically, as shown in FIGS. 2 and 3, the cover 62 further includes an opening 332 provided for passage of the trigger assembly 330 that activates the motor 150. The trigger assembly includes a switch 334 mounted to a bracket 336 which is attached to the cover via a fastener 338. A cap is mounted in the opening and is dimensioned to fit over a switch button 342 which outwardly biases the cap. To engage the switch 334, the cap is pushed downwardly. The switch 334 is electrically connected to the batteries 152 mounted in the nozzle base 20 and the motor 150. As shown in FIG. 11, the location of the trigger assembly 330 enables a user to actuate the trigger assembly with a thumb, while using the remaining fingers of the grasping hand to hold onto the suction and spray wand 12.

The actuated motor rotates the output drive shaft 196 and the spur gear 198. The teeth of the spur gear engage the teeth of the face gear 210. Rotation of the face gear rotates the shaft 212, the cam 214 and the pin 258 mounted to the cam. As the cam rotates, an end of the pin rotates in the oblong aperture 272. As the cam 214 moves in a circular fashion, the pin moves longitudinally in the oblong aperture 272. This, in turn, reciprocates the ram 216. Particularly, and with reference to FIG. 10, as the cam rotates in a clockwise direction, the pin 258, which is shown positioned at one end of the oblong aperture 272, will slide to the other end of the aperture. As the pin moves, the ram 216 will move away from the brushes. Continued rotation of the cam 214 will slide the pin 258 back to the position shown in FIG. 10. This, in turn, will move the ram toward the brushes. It should be appreciated that the reciprocation of the ram is limited by the mounting plate sleeves 290 positioned in the slots 268, 270. The linear movement of the ram 216 oscillates the first and second brushes in unison which are mounted to the C-shaped tabs 286 of the ram via the pins 304.

In one embodiment, the first and second brushes 204, 206 can oscillate by about ten degrees (10°). This small oscillation can extend battery life and can effectively work the weave of a carpet. Of course, the brushes can oscillate to a greater or lesser extent, as desired. The brushes can oscillate so that they rotate in opposite directions, i.e., towards each other and away from each other, or so that they both rotate in the same direction, as desired.

Figure 12:
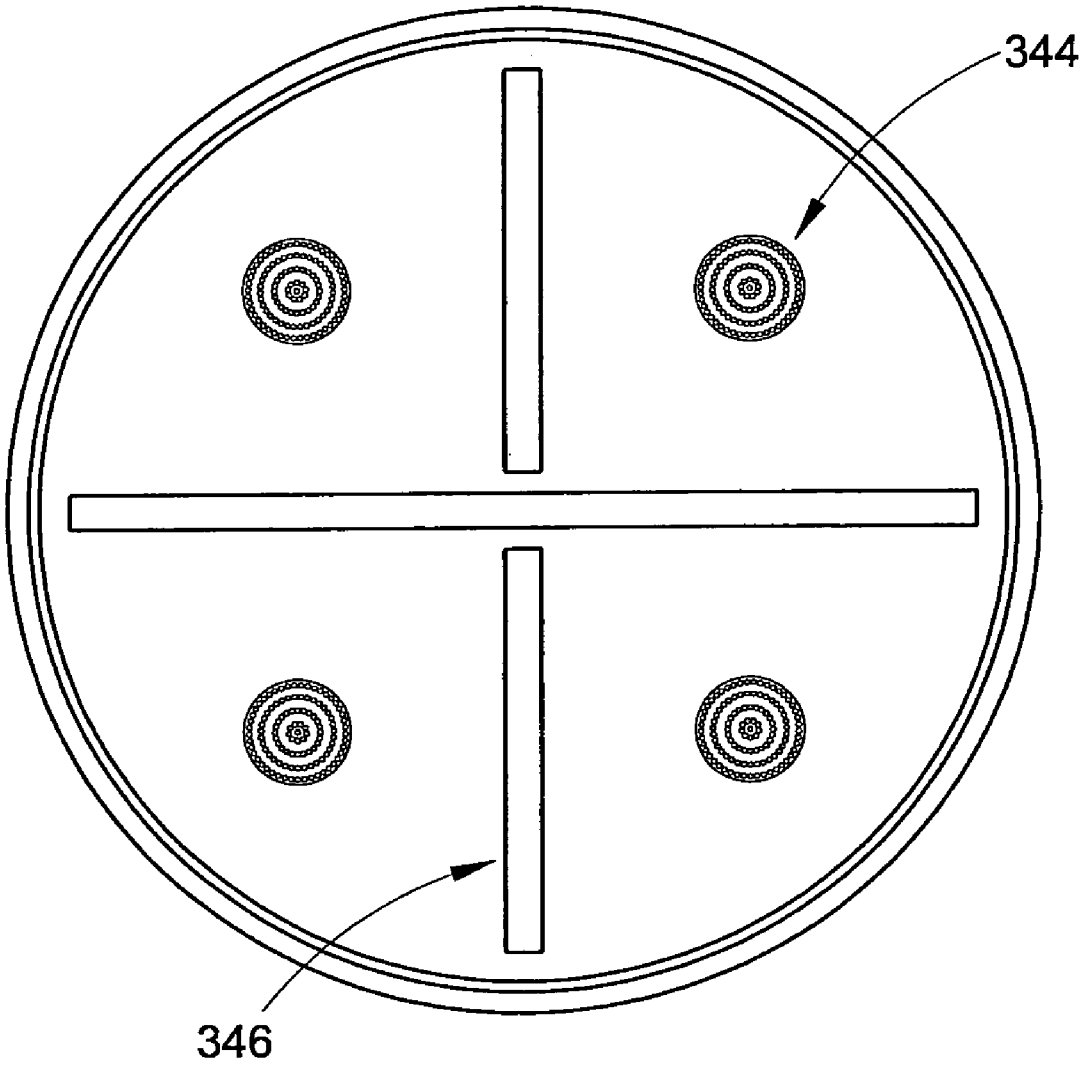
FIGS. 12-14 are alternative cleaning attachments for the hand-held cleaning device of FIG. 1.
Figure 13:
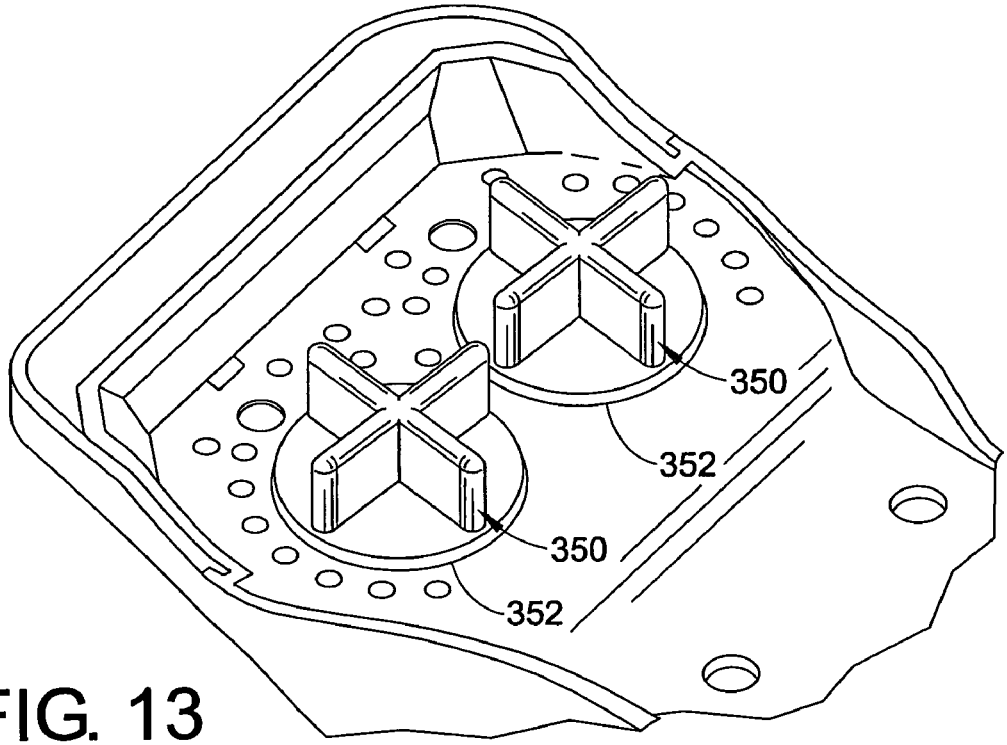
Figure 14:
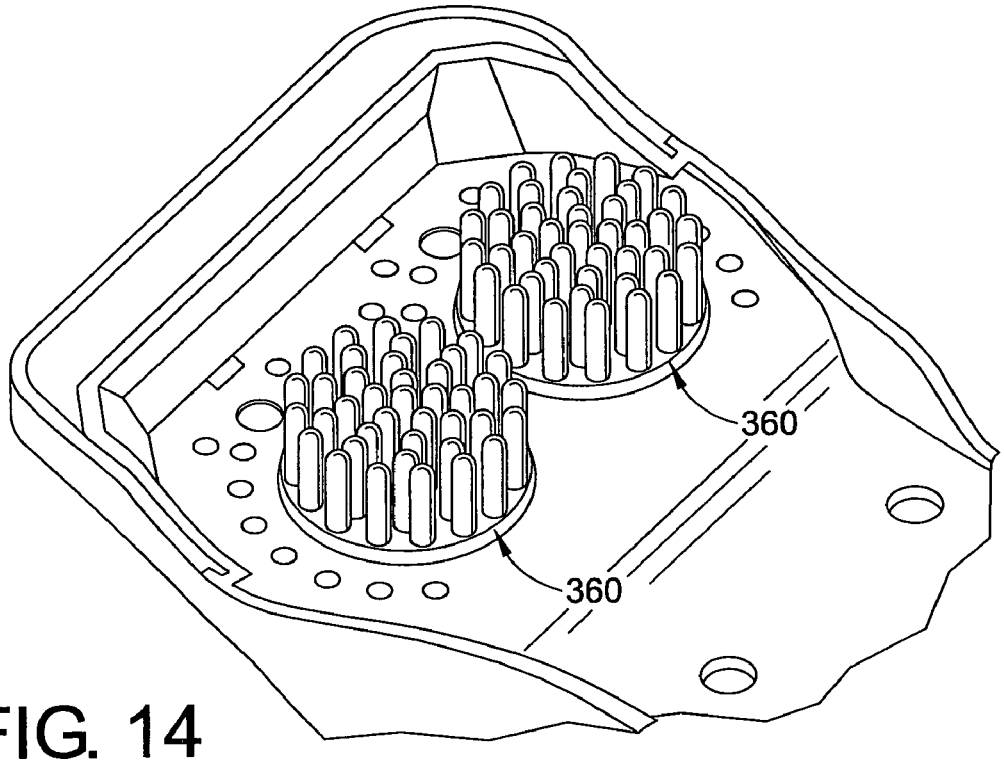

In another embodiment (not illustrated), one or more brushes can rotate, instead of oscillating. However, it should be appreciated that oscillation of the brushes advantageously works carpet cleaning solution down into carpet fiber. While two brushes are shown herein, it should be appreciated that a single brush could be employed. Alternatively, multiple brushes could be used. As mentioned, such brush or brushes could oscillate or rotate as desired. If so desired, alternative cleaning attachments could be employed instead of brushes for the hand-held cleaning device. As shown in FIG. 12, a cleaning attachment can include pads 334 or rubber blades 346 or a combination thereof. As shown in FIG. 13, a pair of cleaning attachments can include rubber blades 350 having a cruciform shape extending outwardly from a base 352. As shown in FIG. 14, a pair of cleaning attachments can include bristles 360 made from an elastomeric or similar material.

Figure 15:
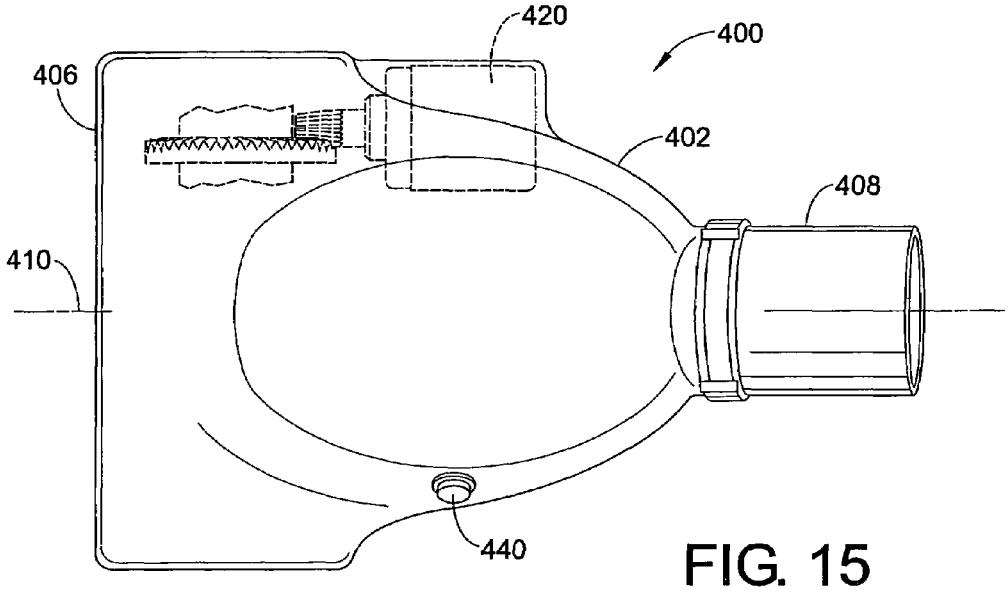
FIG. 15 is a top plan view, partially broken away, of a hand-held cleaning device in accordance with an alternative embodiment of the present invention.
Figure 16:
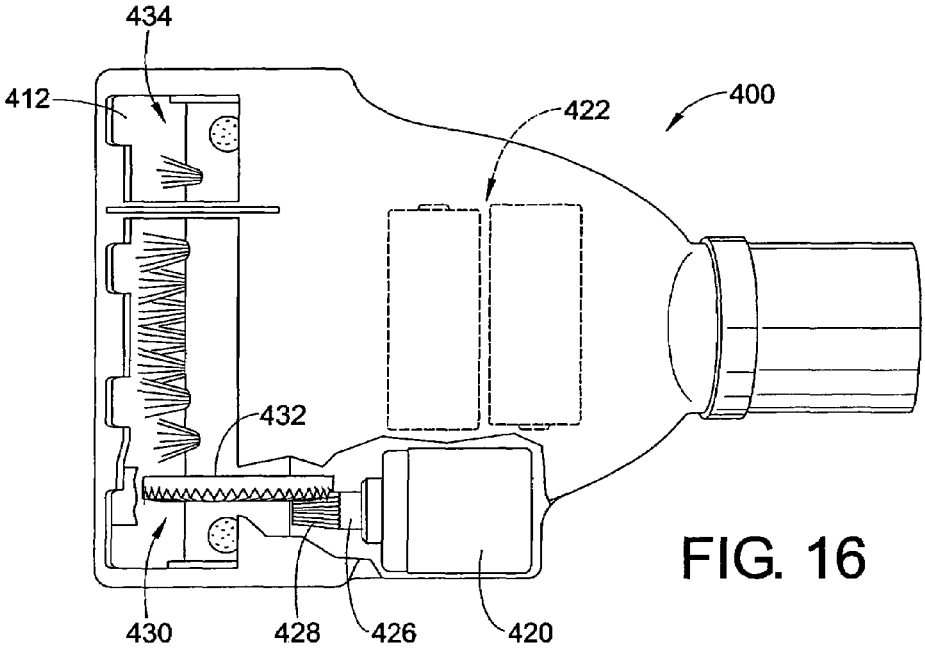
FIG. 16 is a bottom plan view, partially broken away, of the hand-held cleaning device of FIG. 15.

With reference now to FIGS. 15 and 16, an alternative embodiment of a hand-held cleaning device 400 is illustrated.

The hand-held cleaning device 400 includes a generally hollow nozzle base 402 having opposed first and second ends 406 and 408, respectively, and a longitudinal axis 410. The second end 408 of the nozzle base is releasably connected to a hand-held suction wand (not shown) via conventional means. The first end 406 of the nozzle base 402 includes an inlet section or nozzle opening 412 having an inlet through which air entrained dirt flows from a surface to be cleaned.

A motor 420 is located in the nozzle base 402. The motor is electrically connected to a source of energy, such as a battery. In the depicted embodiment, the motor is electrically connected to replaceable batteries 422 housed in the nozzle base. Alternatively, similar to the previous embodiment, the batteries can be rechargeable. The motor includes an output drive shaft 426 which is configured to produce a rotary motion. A longitudinal axis of the shaft is generally aligned with the longitudinal axis 410 of the nozzle base 402. A first bevel gear 428 is securely mounted to an end of the output shaft. A drive assembly 430, which includes a second bevel gear 432, is connected to the output shaft for rotation therewith. The drive assembly is operatively connected to a brushroll 434 having opposed ends rotatably mounted to the nozzle base. The brushroll has an axis of rotation generally perpendicular to the longitudinal axis 410 of the nozzle base. Rotation of the output drive shaft 426 of the motor 420 causes the drive assembly 430 to rotate the brushroll. To actuate the motor 420, a push button assembly 440 is operatively mounted to the nozzle base 402.

The present invention has been described with reference to several preferred embodiments. Obviously, modifications and alterations will occur to others upon reading and understanding the preceding detailed description. It is intended that the present invention be construed as including all such modifications and alterations insofar as they come within the scope of the appended claims or the equivalents thereof.

What we claim is:

1. A hand-held cleaning device comprising:

an elongated nozzle base including opposed first and second ends and a longitudinal axis, said second end being releasably connected to an associated hand-held suction wand of an associated vacuum source, said longitudinal axis of said elongated nozzle base being aligned with a longitudinal axis of said wand;

a battery located exterior to and supported by said elongated nozzle base;

a DC motor located in said elongated nozzle base and electrically connected to said battery, said motor including an output drive shaft;

a drive assembly connected to said drive shaft for rotation therewith; and a first brush located adjacent said first end of said elongated nozzle base, said first brush being connected to said drive assembly, wherein a longitudinal axis defined by said output drive shaft is oriented perpendicular to a longitudinal axis defined by said first brush.

2. The cleaning device of claim 1, wherein said drive shaft is aligned with said longitudinal axis of said elongated nozzle base.

3. The cleaning device of claim 1, wherein a rotational axis of said first brush is oriented generally normal to said longitudinal axis of said elongated nozzle base.

4. The cleaning device of claim 1, wherein said elongated nozzle base includes a sidewall and at least one chamber located on an exterior of said sidewall for housing said battery.

5. The cleaning device of claim 1, wherein said first brush oscillates.

6. The cleaning device of claim 1, further comprising a second brush, wherein said drive assembly includes a connector operatively connected to said first and second brushes, wherein rotation of said output drive shaft of said motor moves said connector generally along said longitudinal axis of said elongated nozzle base in a reciprocating manner causing said first and second brushes to oscillate.

7. The cleaning device of claim 1 further comprising a nozzle cover attached to said first end of said elongated nozzle base.

8. The cleaning device of claim 7, wherein said nozzle cover and said first end of said elongated nozzle base define an inlet section for receiving air entrained dirt from an associated surface to be cleaned.

9. The cleaning device of claim 8, wherein said nozzle cover includes an inwardly depressed section for narrowing a passageway in said inlet section thereby creating a venturi effect for increasing vacuum in said inlet section.

10. The cleaning device of claim 8, wherein an inlet of said inlet section lies in a first plane which is generally parallel to said longitudinal axis of said elongated nozzle base, and wherein an operating surface of the first brush lies in a second plane, said second plane extending at an acute angle relative to said first plane.

11. The cleaning device of claim 1 further comprising a control element for selectively actuating said DC motor.

12. The cleaning device of claim 1, wherein the wand of the associated vacuum source includes a spray nozzle, said spray nozzle including a fluid outlet and being located adjacent said elongated nozzle base, said longitudinal axis of said elongated nozzle base being aligned with a longitudinal axis of said fluid outlet of said spray nozzle.

13. A hand-held motorized cleaning device comprising:

a nozzle base having opposed first and second ends together defining a first longitudinal axis, said second end being operatively connected to an associated hand-held suction wand of an associated vacuum source, said nozzle base including an elongated nozzle opening defining a second longitudinal axis oriented generally normal to said first longitudinal axis and a housing extending outwardly from a sidewall of said nozzle base;

a battery located in said housing;

a motor mounted to said nozzle base and electrically connected to said battery, said motor including an output shaft which is configured to produce a rotary motion;

a drive assembly connected to said output shaft, said drive assembly producing a reciprocating motion; and a first brush connected said drive assembly, said first brush having an axis of rotation generally perpendicular to said first longitudinal axis of said nozzle base and said second longitudinal axis of said nozzle opening.

14. The cleaning device of claim 13, further comprising a second brush spaced from said first brush.

15. The cleaning device of claim 14, wherein said drive assembly operably oscillates said first and second brushes in unison.

16. The cleaning device of claim 15, wherein said drive assembly includes:

a face gear, a shaft having a first end mounted to said face gear and a second end mounted to a cam, and a ram, wherein rotation of said cam causes said ram to reciprocally move in a direction generally perpendicular to said axes of said first and second brushes, said linear movement oscillating said first and second brushes.

17. The cleaning device of claim 13 further comprising a nozzle cover attached to said first end of said nozzle base.

18. The cleaning device of claim 17, wherein said nozzle cover and said first end of said nozzle base define an inlet section for receiving air entrained dirt from an associated surface to be cleaned.

19. The cleaning device of claim 13, wherein a surface engaging section of said first end of said nozzle base includes a plurality of slits for reducing friction between said surface engaging section and an associated surface to be dried or cleaned.

20. A self-powered hand-held cleaning device for connection with a carpet extractor, to enable above floor cleaning, the cleaning device comprising:

a generally hollow nozzle base releasably connected to an associated vacuum source and including a nozzle;

a battery mounted to said nozzle base;

a DC motor mounted to said nozzle base and operably connected to said battery; and first and second brushes operably connected to said motor via a reciprocating connector to produce an oscillating motion of said first and second brushes, at the same time as a suction is drawn at said nozzle, wherein a longitudinal axis defined by said first bush is generally parallel to a longitudinal axis defined by said second brush.

21. The cleaning device of claim 20 further comprising a drive assembly operably connected to said motor for oscillating said first and second brushes.

22. The cleaning device of claim 20, wherein said oscillating motion rotates said first brush in a first direction for a first predetermined period of time and a second direction for a second predetermined period of time; and said oscillating motion rotates said second brush in one of said first direction and said second direction for said first predetermined period of time and in another of said first direction and said second direction for said second predetermined period of time.

23. An auxiliary tool for a vacuum cleaner, the vacuum cleaner including:

a dust collector having a dirty air inlet and a cleaned air outlet, a fluid conduit in communication with the dirty air inlet of the dust collector, and a suction source for selectively establishing and maintaining a suction airstream flowing from the fluid conduit, through the cleaned air outlet and to an exhaust outlet of the suction source, the auxiliary tool comprising:

an elongated nozzle including a sidewall and opposed first and second ends which together define a longitudinal axis of the tool;

said first end including an elongated nozzle opening which is oriented generally perpendicular to said longitudinal axis;

said second end including a fluid channel which is releasably connected to the fluid conduit of the vacuum cleaner for allowing dirt entrained air to flow into the dust collector;

a motor mounted to said nozzle;

a pair of axially opposed battery compartments located on said sidewall of said elongated nozzle;

a battery mounted in each battery compartment for powering said motor, said battery being replaceable exterior of said sidewall of said elongated nozzle;

a drive assembly connected to and rotated by said motor;

a brush mounted to said nozzle and connected to said drive assembly.

24. The auxiliary tool of claim 23, wherein said brush is mounted adjacent said nozzle.

25. The auxiliary tool of claim 23, wherein said brush includes an axis of rotation which is oriented generally perpendicular to a longitudinal axis of said nozzle.

26. The auxiliary tool of claim 23, further comprising:

an electrical circuit connecting said battery to said motor; and a switch in said electrical circuit for selectively actuating said motor.

* * * * *

UNITED STATES PATENT AND TRADEMARK OFFICE

CERTIFICATE OF CORRECTION

PATENT NO. : 7,578,025 B2
APPLICATION NO. : 11/434980
DATED : August 25, 2009
INVENTOR(S) : Kostreba et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 181 days.

Signed and Sealed this

Seventh Day of September, 2010

David J. Kappos

David J. Kappos
*Director of the United States Patent and Trademark Office*